US007121403B2

(12) United States Patent
Bohdan et al.

(10) Patent No.: US 7,121,403 B2
(45) Date of Patent: Oct. 17, 2006

(54) BLANK FORMING CARTON AND CLOSURE THEREFOR

(76) Inventors: Walter Bohdan, 1909 Boyer Rd., Powhatan, VA (US) 23235; Christopher M. Morgan, 12914 Cottage Mill Pl., Midlothian, VA (US) 23114; Christine Hannah Jones, 16255 Catalpa Dr., Hanover, VA (US) 23069; Maureen Jane Jeffrey, 105 Luray Dr., Richmond, VA (US) 23227; James Jerome Petit, 3701 Reeds Landing Cir., Midlothian, VA (US) 23113

( * ) Notice: Subject to any disclaimer, the term of this patent is extended or adjusted under 35 U.S.C. 154(b) by 479 days.

(21) Appl. No.: 10/739,028

(22) Filed: Dec. 19, 2003

(65) Prior Publication Data

US 2005/0133388 A1 Jun. 23, 2005

(51) Int. Cl.
*B65D 85/10* (2006.01)

(52) U.S. Cl. ..... 206/273; 206/242; 206/271; 206/265; 229/229; 229/232; 229/149

(58) Field of Classification Search ..... 206/242, 206/261, 271, 273, 751, 45.2, 45.21, 45.23, 206/45.24, 45.25, 45.28, 45.29, 265; 229/229, 229/232, 149

See application file for complete search history.

(56) References Cited

U.S. PATENT DOCUMENTS

| | | | | |
|---|---|---|---|---|
| 2,973,086 | A * | 2/1961 | Thompson | 206/767 |
| 3,368,739 | A * | 2/1968 | Roccaforte et al. | 229/228 |
| 4,746,019 | A * | 5/1988 | Prater | 229/207 |
| 5,924,559 | A * | 7/1999 | Carrel et al. | 206/45.21 |

* cited by examiner

*Primary Examiner*—Mickey Yu
*Assistant Examiner*—Steven Pollicoff
(74) *Attorney, Agent, or Firm*—Stites & Harbison PLLC; Douglas E. Jackson

(57) ABSTRACT

A blank for forming a carton, the carton formed therefrom, and a closure for the carton are provided for enclosing a plurality of unbound elongate smoking articles. The blank includes a base sub-blank at the distal end which is folded to form an open top box and a lid sub-blank at the proximal end which is folded to form a top for the box. A movable lid sub-panel is formed in the lid sub-blank which is hingedly removable therefrom to open the top of the box and which is reclosable by use of a foldable member provided therein. After opening of the movable lid sub-panel, the foldable member is folded over to form an extending tab which is received in a weakening line provided in an underlying front panel of the carton when it is desired to hold the movable lid sub-panel in a closed position.

20 Claims, 2 Drawing Sheets

BLANK FORMING CARTON AND CLOSURE THEREFOR

BACKGROUND OF THE INVENTION

Smoking articles such as cigarettes and various other articles are frequently provided in box shaped cartons or the like which can be opened in various manners. Typically, cigarettes are formed in packs of twenty, with ten packs then in turn being packaged in a paperboard carton in a 2×5 array. With such a carton, the packs themselves serve to seal and protect the enclosed cigarettes from the environment.

In order to reduce costs, it may be considered desirable to package cigarettes or the like in bulk in a carton with no other protection. Thus, there is a need for a carton which will protect the contents and which, once opened, will be reclosable to protect the contents.

BRIEF SUMMARY OF THE INVENTION

In accordance with the present invention there are provided for enclosing a plurality of unbound elongate smoking articles, a blank for forming a carton, the carton itself, and a closure for the carton.

The blank is an elongate flat blank which is foldably constructed to form the carton and which defines a distal end, a proximal end and respective left and right longitudinal axes extending between the proximal and distal ends. Broadly, the blank includes a base sub-blank at the distal end and a lid sub-blank at the proximal end thereof. The base sub-blank includes, between left and right longitudinal axes, a front base panel having a base weakening line therein. This base weakening line has a laterally directed main base component and longitudinally directed left and right base components extending from opposite lateral sides of the main base component towards the proximal end of the blank. The base sub-blank also includes a bottom base panel hingedly connected about a first lateral axis to the front base panel, and a back base panel hingedly connected about a second lateral axis to the bottom base panel. The lid sub-blank includes, between the respective left and right longitudinal axes, a top lid panel hingedly connected about a third lateral axis to the back base panel, and a front lid panel hingedly connected about a fourth lateral axis to the top lid panel. Thus, when the carton is constructed, the base sub-blank forms a box with an open top and the top lid panel integral therewith forms an enclosing lid for the open top of the box and the front lid panel overlies a distal portion of the front base panel.

Formed in the lid sub-blank of the blank is a movable lid sub-panel which is defined by left and right movable lid weakening lines extending respectively inside of the left and right longitudinal axes, and by a proximal lid weakening line extending laterally from the left and right movable lid weakening lines. The movable lid sub-panel is also connected hingedly about a lid hinge line to a remainder of the blank, and includes a distal lid weakening line located between the fourth lateral axis and the proximal lid weakening line. The distal lid weakening line has a laterally directed main lid component and longitudinally directed left and right lid components extending from opposite lateral sides of the main lid component towards the proximal end of the blank. The movable lid sub-panel further includes left and right laterally directed hinge lines extending respectively between proximal parts of the left and right lid components and respective the left and right movable lid weakening lines.

There is thus defined a foldable member formed by that portion of the movable lid sub-panel located between the proximal lid weakening line, the left and right movable lid weakening lines, the distal lid weakening line, and the left and right hinge lines. When the carton is constructed, the movable lid sub-panel is hingedly separable from a remainder of the top lid panel and the front lid panel to open the carton. Then, when it is desired to close the opened carton, the foldable member is foldable about the left and right hinge lines so that a distal portion of the foldable member adjacent the distal lid weakening line forms a proximally extending tab which is frictionally and/or resiliently received through the base weakening line.

In a preferred embodiment of the blank, the base weakening line is a slit in the front base panel, the distal lid weakening line is a slit in the front lid panel, the left and right movable lid weakening lines are a series of scores in the top lid panel and the front lid panel, and the proximal lid weakening line is a slit in the front lid panel.

In the preferred embodiment of the blank, the left and right base components of the proximal lid weakening line are located at opposite lateral ends of the main base component and extend laterally toward one another as well as longitudinally. In addition, the left and right lid components of the distal lid weakening line are located at opposite lateral ends of the main lid component. Further, the left and right movable lid weakening lines terminate proximally with respective left and right laterally inward components directed toward one another. Still further, the proximal lid weakening line extends between the laterally inward components of the left and right movable lid weakening lines, and includes a distally formed component located distally from the laterally inward components of the left and right movable lid weakening lines.

Also in the preferred embodiment of the blank, the lid hinge line and the third lateral axis are co-extensive, the left and right movable lid weakening lines have respective left and right longitudinal components which intersect perpendicularly with the third lateral axis and which extend respectively between the left and right hinge lines, and the left and right movable lid weakening lines have respective left and right proximal components respectively connecting the left and right laterally inward components and the left and right longitudinal components with the left and right proximal components being angularly directed proximally toward one another.

To provide freshness and to prevent moisture from harming the products or articles in the carton when formed from the blank, a moisture barrier layer is provided integral with a common surface of the base sub-blank and the lid sub-blank.

Preferably, the front base panel includes left and right front side panels hingedly connected respectively on left and right longitudinal sides of the front base panel about the respective left and right longitudinal axes; the bottom base panel includes left and right bottom side panels hingedly connected respectively on left and right longitudinal sides of the bottom base panel about the respective left and right longitudinal axes; the back base panel includes left and right back side panels hingedly connected respectively on left and right longitudinal sides of the back base panel about the respective left and right longitudinal axes; and the top lid panel includes left and right top side panels hingedly connected respectively on left and right longitudinal sides of the top lid panel about the respective left and right longitudinal axes.

The carton of the present invention is formed from a blank having the features as noted above, and the closure of the present invention is formed from the closure elements as noted above, so that it is a front of the carton which includes the closure provided. The carton is opened for the first time by separating the movable lid sub-panel from a remainder of the top lid panel and front lid panel. Then, the foldable member is folded about the left and right hinge lines so that a top portion of the foldable member defined by the upper lid weakening line forms an extending tab extending towards the bottom which can be resiliently or frictionally received through the base weakening line with the portion opposite to the extending tab. In addition, the lower lid weakening line and adjacent portions of the left and right movable lid weakening lines form an upwardly directed tab which is used to lift the extending tab received in the base weakening line and then to expose a portion of the open top of the box underneath of the movable lid sub-panel.

It is an advantage of the present invention that a simple blank is provided from which a carton is easily constructed.

It is also an advantage of the present invention that a carton is constructed from a blank having a moisture barrier integral with a paperboard layer such that the carton is moisture proof.

It is a further advantage of the present invention that the carton formed from the blank includes a closure by which the contents of the carton are accessed by a movable lid sub-panel and by which the contents are again closed over holding of the movable lid sub-panel in place.

It is a still further advantage of the present invention that the opening movement of the movable lid sub-panel does not destroy the integrity of the top of the carton, so that the carton can then be used as a display carton.

It is a yet another further advantage of the present invention that smoking articles can be easily and cheaply packaged in a carton having a moisture barrier, can be easily accessed, and then the carton can be easily reclosed with the movable lid sub-panel held in a closed position.

Other features and advantages of the present invention are stated in or apparent from detailed descriptions of presently preferred embodiments of the invention found hereinbelow.

DETAILED DESCRIPTION OF THE INVENTION

Figure 1:
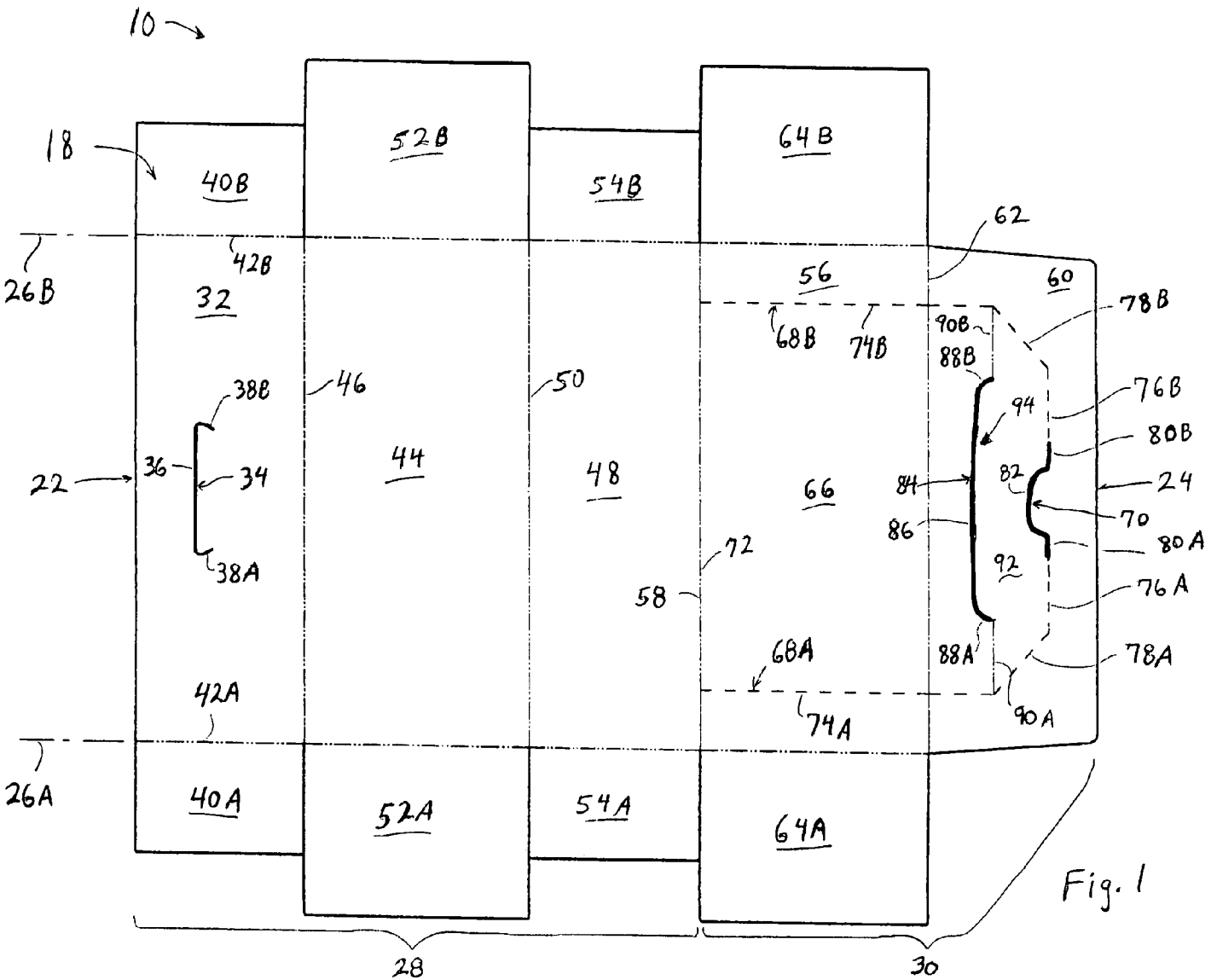
FIG. 1 is a schematic top view of a blank from which a carton is formed in accordance with the present invention.
Figure 4:
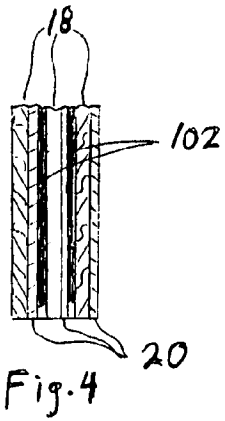
FIG. 4 is a cross-sectional view of a representative portion of a side of the carton depicted in FIG. 2.
Figure 3:
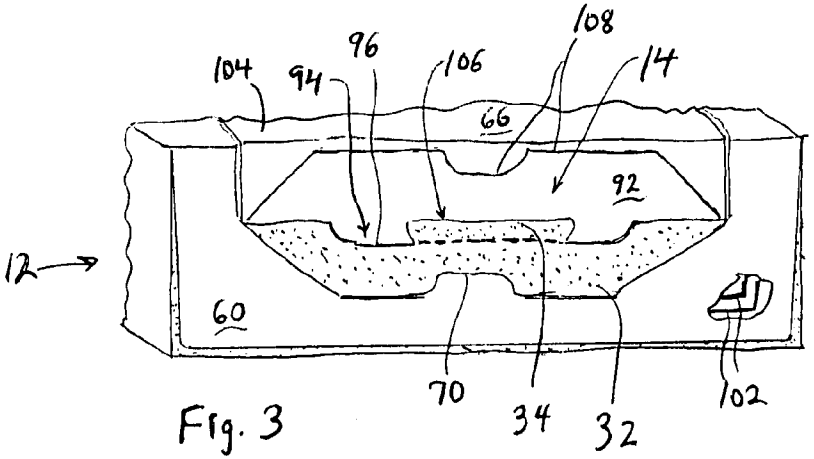
FIG. 3 is a schematic perspective view of the movable sub-panel of the carton depicted in FIG. 2 removably held in a closed position.
Figure 2:
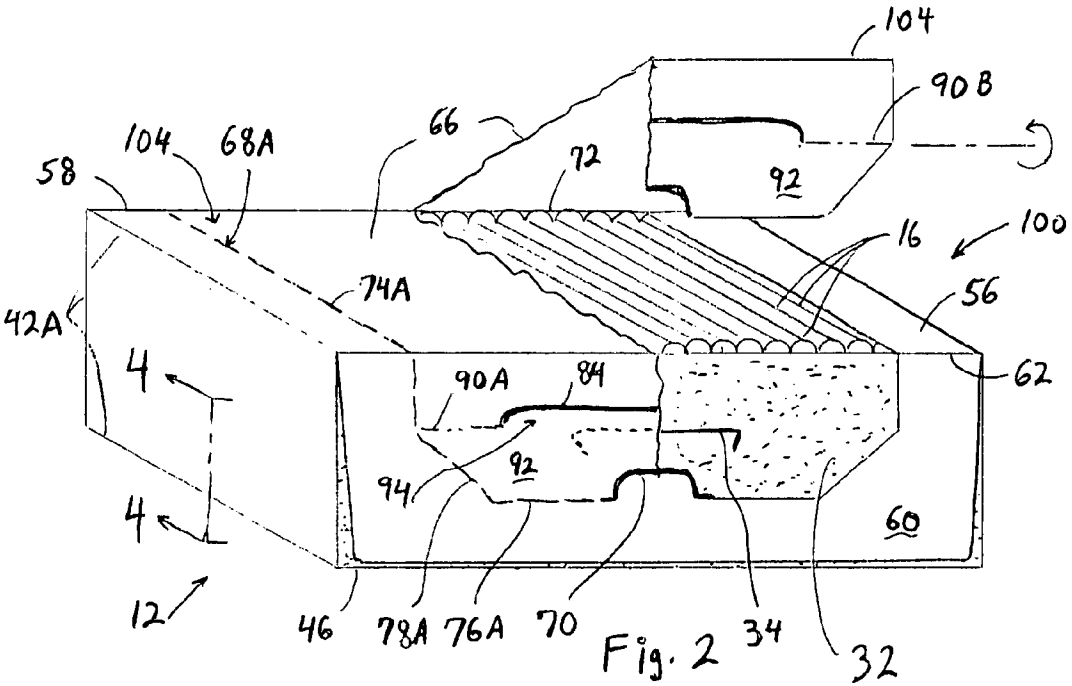
FIG. 2 is a schematic perspective view of a carton formed from the blank depicted in FIG. 1 with split portions of a movable sub-panel in the top shown in an initial closed and a subsequent opened configuration.

With reference now to the drawings in which like numerals represent like elements throughout the views, a blank 10 is depicted in FIG. 1 which is used for forming a carton 12 as depicted in FIGS. 2–4 having a closure mechanism 14 as best shown in FIGS. 2–3. It will be appreciated that carton 12 is designed for the application of providing a tobacco container with the standard unit of two hundred cigarettes 16, but with lower costs by having cigarettes 16 loosely packed or unbound rather than in packs of twenty cigarettes which must therefore include the costs of placing the cigarettes into the packs and then into a carton. Carton 12 must therefore also include a moisture barrier to preserve a certain shelf life for carton 12 before dispensing of cigarettes 16 therein begins by an opening of carton 12.

With reference to FIG. 4, it will initially be appreciated that blank 10 is formed of a structural layer 18 and a moisture barrier 20 integral with the bottom surface of layer 18. For convenience, the two layers are only separately depicted in FIG. 4, with the two (or more where sides overlap) layers in the remaining figures only depicted as a single line. Conveniently, and as well known in the art, structural layer 18 is made of paperboard or a like material while moisture barrier 20 is made of a lamination foil liner or the like. The various cuts or slits in structural layer 18 discussed hereafter are depicted as continuous, but these would typically be formed by a series of cuts or slits separated by very small easily breakable portions (not shown, or alternatively as continuous cuts, slits or slots (wider slits) as well known in the art. Preferably, the cuts or slits are provided in structural layer 18 and these are formed therein prior to provision of moisture barrier 20 thereon. Thus, moisture barrier 20 provides an unbroken or unpierced barrier, and moisture barrier 20 is easily folded and glued thereafter as carton 12 is formed.

For convenience, blank 10 will be described with reference to FIG. 1 as having a distal end 22, a proximal end 24, and left and right longitudinal axes 26A and 26B; but obviously these identifiers and related identifiers used subsequently are arbitrary and used for ease of description and not as limitations. Also for convenience, blank 10 will be described as having a base sub-blank 28 and a lid sub-blank 30, which after folding (and suitable adhering) respectively form an open top box and lid (as described subsequently). Finally, it will be appreciated that thick lines are used to identify where structural layer 18 (but not moisture barrier 20) of blank 10 has been cut or slit, dot-dot-dash lines which are used to signify a fold line, and dash-dash lines larger than those used for hidden lines are used to signify a scored (separated cuts) line.

As shown in FIG. 1, base sub-blank 28 includes a front base panel 32 bordered by left and right longitudinal axes 26A and 26B and having a base weakening line 34 therein which is a slit or cut in structural layer 18. Base weakening line 34 has a laterally directed main base component 36 and longitudinally directed left and right base components 38A and 38B extending from opposite lateral sides of main base component 36 towards proximal end 24 of blank 10. Preferably, base components 38A and 38B extend from opposite lateral rounded ends of main base component 36 and extend laterally toward one another as well as longitudinally so as to have an included angle of about 60° as depicted. Attached laterally to front base panel 32 (on respective left and right longitudinal sides thereof) are respective left and right front side panels 40A and 40B. Respective left and right front side panels 40A and 40B are hingedly connected to front base panel 32 by respective fold lines 42A and 42B provided in structural layer 18 along respective left and right longitudinal axes 26A and 26B.

Base sub-blank 28 also includes a bottom base panel 44 hingedly connected about a first lateral axis 46 to front base panel 32, and a back base panel 48 hingedly connected about a second lateral axis 50 to bottom base panel 44. Bottom base panel 44 and back base panel 48 have respective (i) left and right bottom side panels 52A and 52B and (ii) left and right back side panels 54A and 54B hingedly connected respectively thereto by extensions of left and right fold lines 42A and 42B in a similar manner to those of front base panel 32 so these will not be described further. It will thus be appreciated that when carton 12 is constructed and suitable glue or the like is used to adhere respective front, bottom and back side panels together, base sub-blank 28 forms a box with an open top.

Lid sub-blank 30 includes a top lid panel 56 hingedly connected about a third lateral axis 58 to back base panel 48 and a front lid panel 60 hingedly connected about a fourth lateral axis 62 to top lid panel 56. Top lid panel 56 has respective left and right top side panels 64A and 64B hingedly connected thereto by extensions of left and right fold lines 42A and 42B in a similar manner to those of front base panel 32 (and of bottom base panel 44 and back base panel 48) so these will also not be described further. However, it will be noted that front lid panel 60 does not include any side panels; and that the lateral sides of front lid panel 60 extend slightly inwardly towards one another while the proximal end of front lid panel 60 does not extend longitudinally as far from fourth lateral axis 62 as the distal end of front base panel 32 extends from first lateral axis 46. Thus, and as noted above, when carton 12 is constructed, top lid panel 56 forms an enclosing lid for the open top of the box and front lid panel 56 overlies only a distal portion (but most) of front base panel 32 (as shown and described subsequently with respect to FIGS. 2–3).

Formed in lid sub-blank 30 is a movable lid sub-panel 66. Movable lid sub-panel 66 is defined: (a) by left and right movable lid weakening lines 68A and 68B extending respectively inside of left and right longitudinal axes 26A and 26B, (b) by a proximal (or lower when carton 12 is formed) lid weakening line 70 extending laterally from left and right movable lid weakening lines 68A and 68B, and (c) by a lid hinge line 72. Preferably, left and right movable lid weakening lines 68A and 68B are formed by scored (broken cut or slit) lines or the like in structural layer 18, while proximal lid weakening line 70 is formed by a slit or cut in structural layer 18.

It will be appreciated that left and right movable lid weakening lines 68A and 68B have respective left and right longitudinal components 74A and 74B which extend longitudinally from (or perpendicularly to) lid hinge line 72. In this preferred embodiment, it will be noted that lid hinge line 72 is the same as third lateral axis 58; although lid hinge line could be located on either longitudinal side of third lateral axis 58 if desired. In addition, left and right movable lid weakening lines 68A and 68B terminate proximally with left and right laterally inward components 76A and 76B directed laterally toward one another. Thus, proximal lid weakening line 70 extends between the laterally inward components 76A and 76B. In addition, left and right movable lid weakening lines 68A and 68B include left and right proximal (corner) components 78A and 78B respectively connecting the left and right laterally inward components 76A and 76B and left and right longitudinal components. It will be noted that left and right proximal components 78A and 78B are angularly directed proximally toward one another which will facilitate tearing/breaking of movable lid sub-panel along left and right movable lid weakening lines 68A and 68B from the remainder of lid sub-blank 30 as described subsequently. It will also be noted that proximal lid weakening line 70 includes left and right lateral components 80A and 80B and a distally formed component 82 located distally (upwardly in carton 12) from left and right laterally inward components 76A and 76B of left and right movable lid weakening lines 68A and 68B.

Movable lid sub-panel 66 also includes a distal (or upper when carton 12 is formed) lid weakening line 84 in the form of a slit or cut located between fourth lateral axis 62 and proximal lid weakening line 70. Distal lid weakening line 84 has a laterally directed main lid component 86 and longitudinally directed left and right lid components 88A and 88B extending proximally (or downwardly, when carton 12 is formed) from opposite lateral sides of the main lid component 86 and preferably at the lateral ends thereof. Extending respectively between proximal parts, (and preferably the proximal ends thereof as shown) of left and right lid components 88A and 88B and respective left and right movable lid weakening lines 68A and 68B (and preferably at the intersection of components 74A, 74B and 78A, 78B) are left and right laterally directed hinge lines 90A and 90B. Thus, there is a foldable member 92 formed by that portion of movable lid sub-panel 66 located between proximal lid weakening line 70, left and right movable lid weakening lines 68A and 68B, distal lid weakening line 84, and left and right hinge lines 90A and 90B.

Thus, when carton 12 is constructed from blank 10, carton 12 appears as shown on the left side of FIG. 2. Broadly then, movable lid sub-panel 66 is hingedly separable by movable lid weakening lines 68A and 68B from a remainder of top lid panel 56 and front lid panel 60 as shown by the right side of FIG. 2. In addition, foldable member 92 is foldable about left and right hinge lines 90A and 90B as shown by the arrow in FIG. 2 after movable lid sub-panel 66 is separated. Further, once separated and folded about hinge lines 90A and 90B, a distal portion 94 of foldable member 92 which is defined by distal lid weakening line 84 forms a proximally extending tab 96 as shown in FIG. 3. Tab 96 is then received through base weakening line 36 (after base weakening line 36 is pushed as needed to break it open and form an outwardly biased tab) to removably hold movable lid sub-panel 66 in a position covering and closing carton 12.

As shown in FIGS. 2–3, carton 12 is formed from blank 10 into an open top box 100 formed from base sub-blank 28 so that, from the view depicted in FIG. 2, carton 12 has a front, a back, left and right sides, a top and a bottom. As is known in the art, box 100 is made relatively rigid and is thus held together with good integrity by adhering the respective left and right panels of together using one or more beads of glue or the like (typically applied to blank 10 along the right and left side panels thereof before folding) such as glue bead 102 depicted (at two separated locations) in FIG. 4. It will be noted in FIG. 4 that the section break line defining the section view is located at the position where the edges of left side panel 54A and left side panel 40A are adjacent (not quite abutting) but do not overlap, so that left side panel 54A located in the middle of FIG. 4 is not sectioned and left side panel 40A is not seen (it is located out of the plane of the paper of FIG. 4). Of course, side panels 54 could be located on the outside or inside rather than in the middle as desired. Closing the open top of box 100 is a lid 104 formed from lid sub-blank 30. It will be appreciated that the left and right side panels 64A and 64B of top lid panel 56 are also adhered together with the left and right side panels of sub-blank 28. This forms carton 12 sufficiently rigid, and hence suitable to retain cigarettes 16 therein during shipping/transporting and storage (as shown by the left side of carton 12 in FIG. 2).

It will also be appreciated that front lid panel 60 is adhered to front base panel 32 by one or more glue beads 102 therebetween which are located between movable lid sub-panel 66 and the side and bottom edges of front lid panel 60 as shown in the broken out part of front lid panel 60 in FIG. 3. Thus, front lid panel 60 is held securely in place by glue beads 102, and glue beads 102 provide a barrier to moisture as well to seal air from cigarettes 16 in the otherwise open area between the top edge of front base panel 32 and the top (folded) edge of front lid panel 60. For the remainder of carton 12, moisture barrier 20 beneath each paperboard layer serves to provide protection from moisture and air, with glue beads 102 at the side panels also effecting a moisture barrier thereat.

In order to initially open carton 12, the user inserts a fingernail or the like through proximal weakening line 70 or otherwise pushes/pulls on the area around proximal weakening line 70 to open proximal weakening line 70 up completely (now a continuous cut). This allows the user to grasp foldable member 92 and to pull outwards from the plane of the remainder of front lid panel 60 and then upwards thereon. The outward and upward pulling movement of foldable member 92 causes left and right lid weakening lines 68A and 68B to fail, or in other words for lid 14 to tear therealong starting at laterally inward components 76A and 76B and all of the way back to lid hinge line 72. Thus, movable lid sub-panel 66 is hingedly separated from a remainder of lid sub-blank 30 and is raised about lid hinge line 72 to the (or more conveniently, a higher) position shown by the right hand side of FIG. 2. For convenience of illustration, it will be noted that the portions of front base panel 60 which are viewable in FIGS. 2 and 3 have been stippled to more readily distinguish these portions from the otherwise mostly overlying portions of front lid panel 60. In this open position of movable lid sub-panel 66, cigarettes 16 can be first accessed from carton 12 by the user, and if desired carton 12 can then be used as an open display carton with movable lid sub-panel moved completely out of the way from cigarettes 16.

When the user no longer wishes to access cigarettes after opening movable lid sub-panel 66 and instead wishes to close carton 12, closure mechanism 14 is effected. Closure mechanism 14 includes foldable member 92 which is folded about laterally directed hinge lines 90A and 90B, as shown by the arrow in FIG. 2 opposite laterally directed hinge line 90B. It will be noted that foldable member 92 is folded so that distal or top portion 94 of foldable member 92 forms tab 96 which is then pointed downwards or towards base weakening line 34. The user then pulls out with a fingernail or the like (or otherwise pushes/pulls) the area of front base panel 32 bounded by base weakening line 34 so that base weakening line 34 forms a trap 106 behind which tab 96 can be held resiliently or frictionally against a remainder of front base panel 32. In this position, that movable lid sub-panel 66 again closes the open top of box 100 (but not air-tight, of course). It will be noted that the now upward edges of proximal lid weakening line 70 and laterally inward components 76A and 76B of left and right movable lid weakening lines 68A and 68B form an upwardly directed tab 108, due to the resiliency of paperboard layer 18 at fold lines 90A and 90B, so that tab 108 is not flat against (co-planar with) the remainder of movable lid sup-panel 66. Thus, tab 108 is easily grasped by the user to facilitate the movement of tab 96 behind trap 106. In addition, tab 108 is also easily grasped by the user when it is desired to move movable lid sub-panel 66 to the open position where cigarettes 16 can again be accessed.

While the present invention has been described with respect to exemplary embodiments thereof, it will be understood by those of ordinary skill in the art that variations and modifications can be effected within the scope and spirit of the invention.

We claim:

1. An elongate flat blank which is foldably constructed to form a carton for enclosing a plurality of unbound elongate smoking articles and which elongate flat blank defines a distal end, a proximal end and respective left and right longitudinal axes extending between the proximal and distal ends, said elongate flat blank comprising:

a base sub-blank at the distal end of the blank, said base sub-blank and including between said left and right longitudinal axes (a) a front base panel having a base weakening line therein, said base weakening line having a laterally directed main base component and longitudinally directed left and right base components extending from opposite lateral sides of the main base component towards the proximal end of the blank, (b) a bottom base panel hingedly connected about a first lateral axis to said front base panel, (c) a back base panel hingedly connected about a second lateral axis to said bottom base panel, whereby, when the carton is constructed, said base sub-blank forms a box with an open top;

a lid sub-blank at the proximal end of the blank, said lid sub-blank including between the respective left and right longitudinal axes (a) a top lid panel hingedly connected about a third lateral axis to said back base panel, (b) a front lid panel hingedly connected about a fourth lateral axis to said top lid panel, whereby, when the carton is constructed, said top lid panel forms an enclosing lid for the open top of the box and said front lid panel overlies a distal portion of said front base panel;

a movable lid sub-panel formed in said lid sub-blank, said movable lid sub-panel (a) being defined by (i) left and right movable lid weakening lines extending respectively inside of the left and right longitudinal axes, and (ii) a proximal lid weakening line extending laterally from said left and right movable lid weakening lines, (b) being connected hingedly about a lid hinge line to a remainder of the blank, (c) including a distal lid weakening line located between the fourth lateral axis and said proximal lid weakening line, said distal lid weakening line having a laterally directed main lid component and longitudinally directed left and right lid components extending from opposite lateral sides of the main lid component towards the proximal end of the blank, (d) including left and right laterally directed hinge lines extending respectively between proximal parts of said left and right lid components and respective said left and right movable lid weakening lines, and (e) defining a foldable member formed by that portion of said movable lid sub-panel located between said proximal lid weakening line, said left and right movable lid weakening lines, said distal lid weakening line, and said left and right hinge lines, whereby, when the carton is constructed, (i) said movable lid sub-panel is hingedly separable from a remainder of said top lid panel and said front lid panel, and (ii) said foldable member is foldable about said left and right hinge lines after said movable lid sub-panel is separated so that a distal portion of said foldable member adjacent said distal lid weakening line forms a proximally extending tab which can be received through said base weakening line.

2. An elongate flat blank as claimed in claim 1:

wherein said base weakening line is a slit in said front base panel; and wherein said distal lid weakening line is a slit in said front lid panel.

3. An elongate flat blank as claimed in claim 2:

wherein said left and right movable lid weakening lines are a series of scores in said top lid panel and said front lid panel; and wherein said proximal lid weakening line is a slit in said front lid panel.

4. An elongate flat blank as claimed in claim 3:

wherein the left and right base components of said proximal lid weakening line are located at opposite lateral ends of said main base component and extend laterally toward one another as well as longitudinally;

wherein the left and right lid components of said distal lid weakening line are located at opposite lateral ends of said main lid component.

5. An elongate flat blank as claimed in claim 4:

wherein said left and right movable lid weakening lines terminate proximally with respective left and right laterally inward components directed toward one another; and wherein said proximal lid weakening line extends between the laterally inward components of said left and right movable lid weakening lines, and includes a distally formed component located distally from the laterally inward components of said left and right movable lid weakening lines.

6. An elongate flat blank as claimed in claim 5:

wherein said lid hinge line and said third lateral axis are co-extensive;

wherein said left and right movable lid weakening lines have respective left and right longitudinal components which intersect perpendicularly with said third lateral axis and which extend respectively between said left and right hinge lines; and wherein said left and right movable lid weakening lines have respective left and right proximal components respectively connecting the left and right laterally inward components and the left and right longitudinal components, the left and right proximal components being angularly directed proximally toward one another.

7. An elongate flat blank as claimed in claim 1, further including a moisture barrier layer integral with a common surface of said base sub-blank and said lid sub-blank.

8. An elongate flat blank as claimed in claim 1:

wherein said front base panel includes left and right front side panels hingedly connected respectively on left and right longitudinal sides of said front base panel about the respective left and right longitudinal axes;

wherein said bottom base panel includes left and right bottom side panels hingedly connected respectively on left and right longitudinal sides of said bottom base panel about the respective left and right longitudinal axes;

wherein said back base panel includes left and right back side panels hingedly connected respectively on left and right longitudinal sides of said back base panel about the respective left and right longitudinal axes; and wherein said top lid panel includes left and right top side panels hingedly connected respectively on left and right longitudinal sides of said top lid panel about the respective left and right longitudinal axes.

9. A carton for enclosing a plurality of unbound elongate smoking articles comprising:

an open top box (a) including a front base panel, left and right side panels of said front base panel, a bottom base panel, left and right side panels of said bottom base panel, a back base panel, and left and right side panels of said back base panel, (b) defining left and right sides, an open top and a bottom, (c) having said bottom base panel hingedly connected about a first lateral axis to said front base panel, (d) having said back base panel hingedly connected about a second lateral axis to said bottom base panel, and (e) having respective said left and right side panels of said front base panel, of said bottom base panel and of said back base panel adhered together to provide rigidity to said open top box;

a lid for closing said open top of said box, said lid (a) including a top lid panel, left and right side panels of said top lid panel, and a front lid panel;

(b) having said top lid panel hingedly connected about a third lateral axis to said back base panel and extending over the top of said open top box, (c) having said front lid panel hingedly connected about a fourth lateral axis to said top lid panel and overlying a top portion of said front base panel, and (d) having respective said left and right side panels of said top lid panel also adhered to the respective said left and right side panels of said front base panel, of said bottom base panel and of said back base panel to provide rigidity to the carton;

wherein said front base panel includes a base weakening line therein having (i) a main base component directed from adjacent the right side to adjacent the left side and (ii) left and right base components extending from opposite left and right parts of the main base component and directed towards the bottom;

wherein said lid has defined therein a movable lid sub-panel, said movable lid sub-panel (a) being defined by (i) left and right movable lid weakening lines in said top lid panel and said front lid panel extending respectively frontally from adjacent said third lateral axis and inside of said left and right side panels of said top lid panel, and (ii) a lower lid weakening line in said front lid panel extending between bottom parts of said left and right movable lid weakening lines, (b) being connected hingedly about a lid hinge line to a remainder of the carton, (c) including an upper lid weakening line located between the fourth lateral axis and said lower lid weakening line, said upper lid weakening line having a sideward directed main lid component and left and right lid components extending respectively from opposite left and right side parts of the main lid component towards the bottom of the box, (d) including left and right sideward directed hinge lines extending respectively between bottom parts of said left and right lid components and respective said left and right movable lid weakening lines, and (e) defining a foldable member formed by that portion of said movable lid sub-panel located between said lower lid weakening line, said left and right movable lid weakening lines, said upper lid weakening line, and said left and right hinge lines, whereby (i) said movable lid sub-panel is hingedly separable from a remainder of said top lid panel and said front lid panel, and (ii) said foldable member is foldable about said left and right hinge lines after said movable lid sub-panel is separated so that a top portion of said foldable member defined by said upper lid weakening line forms an extending tab extending towards the bottom which can be received through said base weakening line.

10. A carton as claimed in claim 9:

wherein said base weakening line is a slit in said front base panel; and wherein said upper lid weakening line is a slit in said front lid panel.

11. A carton as claimed in claim 10:

wherein said left and right movable lid weakening lines are a series of scores in said top lid panel and said front lid panel; and wherein said lower lid weakening line is a slit in said front lid panel.

12. A carton as claimed in claim 11:

wherein the left and right base components of said lower lid weakening line are located at opposite lateral ends of said main base component and extend laterally toward one another as well as downwardly;

wherein the left and right lid components of said upper lid weakening line are located at opposite lateral ends of said main lid component.

13. A carton as claimed in claim 12:

wherein said left and right movable lid weakening lines terminate downwardly with respective left and right laterally inward components directed toward one another; and wherein said lower lid weakening line extends between the laterally inward components of said left and right movable lid weakening lines, and includes an upwards formed component located upwardly from the laterally inward components of said left and right movable lid weakening lines.

14. A carton as claimed in claim 13:

wherein said lid hinge line and said third lateral axis are co-extensive;

wherein said left and right movable lid weakening lines have respective left and right top components which intersect perpendicularly with said third lateral axis and which extend respectively between said left and right hinge lines; and wherein said left and right movable lid weakening lines have respective left and right lower components respectively connecting the left and right laterally inward components and the left and right top components, the left and right lower components being angularly directed downwards toward one another.

15. A carton as claimed in claim 9, wherein said panels all include a paperboard layer and a moisture barrier layer integral therewith.

16. A closure mechanism for a carton enclosing a plurality of unbound elongate smoking articles, where the carton is comprised of a box with an open top and where the box defines a front, a bottom, a back, a left side and a right side, said closure mechanism comprising:

a front base panel (a) forming the front of the open top box, and (b) including a base weakening line therein having (i) a main base component directed from adjacent the right side to adjacent the left side and (ii) left and right base components extending from opposite left and right parts of the main base component and directed towards the bottom;

a lid which closes the open top of the box, said lid (a) including a top lid panel extending over the open top and a front lid panel extending over a top portion of said front base panel;

(b) having said top lid panel hingedly connected to the back of the box, and (c) having said front lid panel hingedly connected about a lateral axis to said top lid panel;

a movable lid sub-panel in said lid, said lid sub-panel (a) being separated from a remainder of said top lid panel and said front lid panel by (i) left and right movable lid weakening lines in said top lid panel and said front lid panel extending respectively frontally from adjacent the left and right sides of the box, and (ii) a lower lid weakening line in said front lid panel extending between bottom parts of said left and right movable lid weakening lines, (b) being connected hingedly about a lid hinge line to the remainder of the carton, (c) including a upper lid weakening line located between the fourth lateral axis and said lower lid weakening line, said upper lid weakening line having a sideward directed main lid component and left and right lid components extending respectively from opposite left and right side parts of the main lid component towards the bottom of the box, (d) including left and right sideward directed hinge lines extending respectively between bottom parts of said left and right lid components and respective said left and right movable lid weakening lines whereby a foldable member is formed by that portion of said movable lid sub-panel located between said lower lid weakening line, said left and right movable lid weakening lines, said upper lid weakening line, and said left and right hinge lines (e) having said folded member folded about said left and right hinge lines frontally of a remainder of said front lid panel whereby (i) a top portion of said foldable member defined by said upper lid weakening line forms an extending tab extending towards the bottom and which said extending tab is received through said base weakening line to hold said movable lid sub-panel removably in place to close the open top, and (ii) said lower lid weakening line and adjacent portions of said left and right movable lid weakening lines form an upwardly directed tab which is used to lift the extending tab received in said base weakening line and then to expose a portion of the open top of the box underneath of said movable lid sub-panel.

17. A closure mechanism for a carton as claimed in claim 16:

wherein said base weakening line is a slit in said front base panel; and wherein said upper lid weakening line is a slit in said front lid panel.

18. A closure mechanism for a carton as claimed in claim 17:

wherein said left and right movable lid weakening lines are a series of scores in said top lid panel and said front lid panel; and wherein said lower lid weakening line is a slit in said front lid panel.

19. A closure mechanism for a carton as claimed in claim 18:

wherein the left and right base components of said lower lid weakening line are located at opposite lateral ends of said main base component and extend laterally toward one another as well as downwardly;

wherein the left and right lid components of said upper lid weakening line are located at opposite lateral ends of said main lid component.

20. A closure mechanism for a carton as claimed in claim 19:

wherein said left and right movable lid weakening lines terminate downwardly with respective left and right laterally inward components directed toward one another;

wherein said lower lid weakening line extends between the laterally inward components of said left and right movable lid weakening lines, and includes an upwards formed component located upwardly from the laterally inward components of said left and right movable lid weakening lines;

wherein said left and right movable lid weakening lines have respective left and right top components in said top lid panel and said front lid panel which extend respectively between said left and right sides; and wherein said left and right movable lid weakening lines have respective left and right lower components respectively connecting the left and right laterally inward components and the left and right top components, the left and right lower components being angularly directed downwards toward one another.

* * * * *